US005754111A

United States Patent [19]

Garcia

[11] Patent Number: 5,754,111

[45] Date of Patent: May 19, 1998

[54] MEDICAL ALERTING SYSTEM

[76] Inventor: Alfredo Garcia, 4001 Segovia, Coral Gables, Fla. 33146

[21] Appl. No.: 531,368

[22] Filed: Sep. 20, 1995

[51] Int. Cl.[6] ..... G08B 23/00

[52] U.S. Cl. ..... 340/573; 340/502; 340/825.44; 379/38

[58] Field of Search ..... 340/573, 825.44, 340/825.5, 311.1, 519, 502; 379/37, 38; 364/413.02; 128/903, 904

[56] References Cited

U.S. PATENT DOCUMENTS

| | | | |
|---|---|---|---|
| 4,064,368 | 12/1977 | Dibner | 379/38 |
| 5,128,979 | 7/1992 | Reich et al. | 379/40 |
| 5,319,355 | 6/1994 | Russek | 340/573 |
| 5,437,024 | 7/1995 | French | 395/600 |
| 5,534,851 | 7/1996 | Russek | 340/573 |

OTHER PUBLICATIONS

Clarity Medical Corporation trade literature entitled "LabAlert™ Wireless Lab Data Delivery System", Clarity Medical Corporation, Cambridge, Massachusetts, 1995.

Undated letter from Mark A. Anderson, Marketing Director for Clarity Medical Corporation with copies of accompanying Clarity Medical Corporation trade literature relating to LabAlert.

Veterans' Administration invoice for Order No. 664–A49199, Sep. 16, 1994. (Product not written or tested as of this date.).

Heroix trade literature entitled "Robomon", Heroix, Newton, Massachusetts, Aug. 1995.

*Primary Examiner*—Thomas Mullen

*Attorney, Agent, or Firm*—Duane, Morris & Heckscher LLP

[57] ABSTRACT

Medical alerting systems and procedures are provided which can communicate a message representative of a healthcare condition to one or more target recipients. The system includes a receiver which accepts data or indicia of the healthcare condition, and a processor, which assigns a preselected output to the data or indicia and which maps the output to a particular primary target recipient. A transmitter then signals the preselected output to a target. The system can be set up to record a confirmation that the message has indeed been delivered to the target and can be programmed to escalate to a secondary target in the event the primary target does not acknowledge receipt within a preset time limit.

20 Claims, 1 Drawing Sheet

MEDICAL ALERTING SYSTEM

FIELD OF THE INVENTION

This invention relates to alerting systems for communicating events or conditions deemed important in delivering healthcare, for example, laboratory tests conducted for medical diagnoses. More particularly, this invention relates to alarm systems which can communicate emergency medical information relating to a healthcare condition on an escalated, systematic basis.

BACKGROUND OF THE INVENTION

It is common for care providers to request tests regularly from patients, and it is common for the testing facility to be physically located elsewhere within a hospital or off-site. Of course, the primary caregiver, the patient's physician, is not always available when the test results are completed by the laboratory. In the event that test results indicate a life-threatening condition, it is required by law that the primary caregiver, or his designee, be alerted.

Alarm systems for providing alerting signals to monitoring stations for non-medical emergencies have been around for some time. Most of these monitoring systems require specialized electronic receivers and transmitters, as well as specifically trained personnel to monitor the monitoring system. Usually a designated event triggers a signal which is sent either to a dedicated monitoring system, such as premise and patient monitoring devices, or a non-dedicated recipient, or "target", using the telephone voicemail system or beeper.

Such monitoring systems are often event specific. In other words, the alarm signal is sent continuously until the event ceases. After the alarm is sent, monitoring personnel assume responsibility for not missing the signal. If the event is still detected after a certain period, the signal is again sent to the targets. After a period of time, if the event is still detected, the signal may be sent to one or more backup targets. Such systems also provide for using different types of media, such as E-Mail or the telephone, if the event is still detected after a waiting period following contacting the backup targets.

Associated with these event-sensitive alarm systems is usually some level of messaging strategy. Some systems are set up to incorporate the information about the triggering event in the message signal, and can translate this message to various media depending upon predetermined parameters. For example, one such system may send a voicemail to the target during working hours, but send a signal to the target's beeper during the evening.

There are some notable shortcomings to event-based alarm systems. Generally, the type of event is interpreted and translated by an operator that is urged to follow certain instructions. This can lead to human interpretation errors. Additionally, the signaling to the targets and the hierarchy of the escalation are usually predefined for the system, and are not sensitive to the type of event or the content of the information. Additionally, backup measures are typically taken because the event continues and not because of a confirmed delivery of the message. For example, a voicemail system will periodically page users for on-play voicemail, and will stop paging when the voicemail is played, but these systems do not necessarily confirm that the intended user heard the message.

Event-based alarm systems also tend to be highly deterministic. They generally recognize the same event, and send the same signal to the same targets or back-up targets.

Recently, there have been efforts to create alarm systems for laboratory tests. One system, called the LabAlert by Clarity Medical Inc., is known to monitor laboratory system test results to detect life-threatening conditions. Clarity Medical's system focuses on remote, instant reporting of lab results to users on 2-way wireless devices or alpha-numeric pagers. In the case of critical lab results, the Clarity system repeatedly sends the report to users with 2-way wireless devices until an acknowledgement comes back. (Unfortunately, JCAHO, the hospital accreditation agency cited this feature as insufficient because there was no security to determine who was using the device at the time). Clarity claims to also send messages to PDA's, fax machines and special alpha-numeric pagers. They also claim modules for pharmacy, radiology and ADT.

Another system created by the Department of Veteran Affairs interfaces with the Veteran Administration's DHCP hospital information system to perform an alert function. This system uses the VA hospitals' local network to repeatedly interrupt target recipients while they are using terminals until these recipients read their E-Mail. This system delivers an electronic confirmation of receipt, and will simultaneously alert all targets pre-identified for the event and will cease all alerting activities when the first target accepts the alert. As with Clarity Medical's system, the VA system cannot work with most generic communications systems, such as cellular telephones or personal voice pagers.

Accordingly, there is a need for an alarm system for reporting laboratory results which can be customized for various search strategies, depending upon the triggering event, target, and site-specific parameters. The system should be easy to use and provide for delivery through existing media without expensive capital equipment expenditures.

SUMMARY OF THE INVENTION

Medical alerting systems are provided for communicating a timely message representative of a healthcare event deemed important by users, such as a test result from a medical laboratory, to one or more target recipients. In one specific embodiment, the system includes a receiver for accepting indicia, such as data obtained from a hospital information system comprising, for example, laboratory, radiology, pharmacy, outpatient scheduling, patient records, ADT and various other healthcare applications. It also includes a processor for assigning a preselected output relating to the indicia to at least one target recipient. A transmitter is then provided for signalling the output to the target. A recorder is also provided for recording evidence that the output has been delivered to an authorized recipient, which may be the target, or someone else authorized by the user.

The alerting systems of this invention can be used with existing telephone, beeper, personal pager, overhead pagers, printers, facsimiles, E-Mail and loud speaker systems. They can be customized to provide variables in the search strategy, escalation strategy, confirmation requirements and message content.

For example, in another embodiment of this invention, the strategy and effort for locating targets and reporting a triggering event to a particular target can be different for the event "You have a new voicemail" than for the event "life-threatening lab result detected". The targets themselves might vary according to the nature of the triggering event, as well as the prior target and site-specific parameters. For example, a patient may have fallen off her bed, and the message can be directed to a floor nurse, instead of the primary care-giving physician.

It can be deduced that the confirmation of delivery for the range of alert messages can vary from no confirmation needed, to various confirmation types which include a unique recipient identifier or code. Preferred embodiments of this invention will record receipt of this code as well as the time that it is received.

Alarm outputs for this invention can range from a broadcast over a public alert system to a message left in a private voice box. The message content may vary for the same event depending upon the media used for delivery and the desired targets.

In still another embodiment of this invention, the system can include processing means which escalate to select at least one secondary target recipient in the event the primary target recipient does not acknowledge receipt of the preselected output within a time limit.

A BRIEF DESCRIPTION OF THE DRAWINGS

The accompanying drawing illustrates a preferred embodiment of this invention so far devised for the practical application of the principles thereof, and in which:

FIG. 1: is a block diagram for the preferred processing of medical status information by the alerting system of this invention.

DEFINITIONS

Target recipient: party that the alert system intends to signal.

Authorized recipient: party who has been authorized to receive and act on a signalled message, whether or not he or she has been identified as a target recipient.

DETAILED DESCRIPTION OF THE INVENTION

Figure 1:
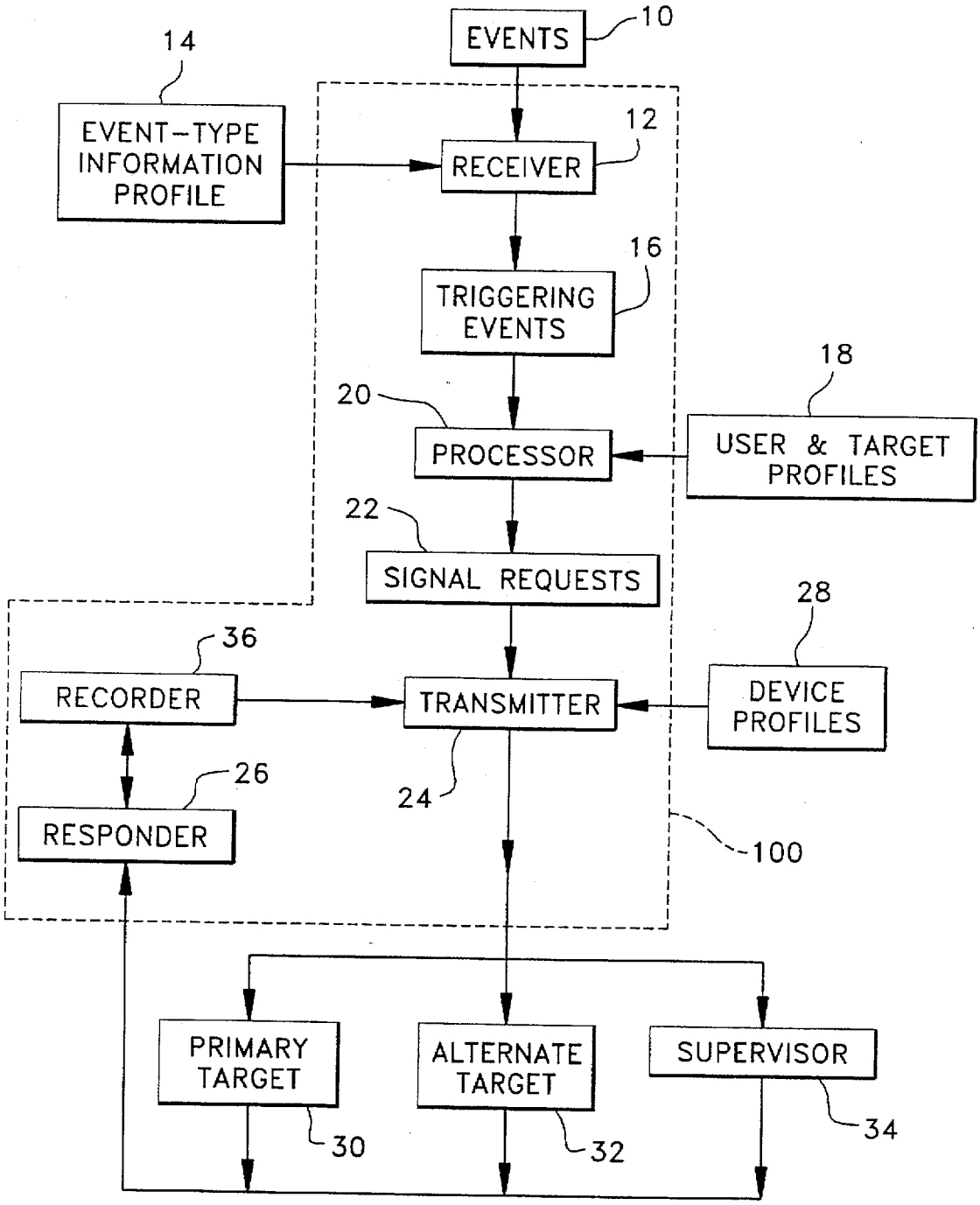

The present invention provides alerting systems that provide the fundamental purpose of searching for target recipients that are not actively monitoring for events or conditions that trigger the alert. The present invention doesn't merely send signals to monitoring agents or devices, but can identify one or more preferred agents to receive an alert signal given user preferences for who should respond to a particular type of event. The system also can signal the preferred recipients over one or more types of widely available communications devices, also depending upon user preferences. Instead of terminating the program when the message has been signaled, this novel system can also determine that an intended target or authorized recipient has received the alert, and if not, escalate to one or more alternative recipients deemed acceptable by the users of the system. These alternative agents can be systematically programmed into the system for different message and media types, assuming the preferred recipients cannot be confirmed in a predetermined time limit.

With reference to FIG. 1, a preferred block diagram for the medical alerting system 100 of this invention is provided. This invention provides recognition and timely message delivery for any number of events 10 associated with conditions deemed important in delivering healthcare.

The preferred invention recognizes "indicia" or events relating to "healthcare conditions" from a hospital information system or network, for example, which may include information and data obtained from the laboratory, radiology, pharmacy, ADT, outpatient scheduling, dentistry, patient records and various other healthcare specialty modules, as well as various internal health delivery, communications, support and administration systems and applications.

Events 10 arrive into a network event file monitored by a receiver 12 that uses an event-type information profile 14 to identify triggering events 16 that users would like to deliver in a time-sensitive fashion with confirmed delivery to selected targets via the alerting system 100. The event-type information profile may also indicate if an on-going alert from an earlier triggering event can be revoked if a certain other event takes place or the event record itself is changed in a predetermined manner.

Given a specific triggering event 16, a processor 20 prepares a search plan based on the type of triggering event 16 and the user and target profiles 18 that describe how users would like to conduct the alerting. This search plan identifies the type, manner and timing of signalling desired for signalling the targets, and escalation requirements for signalling back-ups. One example of a search strategy is described in Table I.

TABLE I

| | Sample Alerting Scheme | | | |
|---|---|---|---|---|
| Characteristic | CRITICAL | IMPORTANT | NOTICE | Non-Alert |
| CONFIRMATION LEVEL | | | | |
| •Primary | •Private | •Private | •None | |
| •Alternate | •Private | •Class | •None | |
| •Supervisory | •Private | •Class | •None | |
| ESCALATION | | | | |
| •Type | •Primary, Alternate & Supervisory | •Primary & Alternate | •Primary only | |
| •Priority Change | •Increase | •No change | •Decrease | |
| •Do simultaneous searching | •Yes | •Yes | •No | |

TABLE I-continued

| Characteristic | Sample Alerting Scheme CRITICAL | IMPORTANT | NOTICE | Non-Alert |
|---|---|---|---|---|
| SEARCH TIME | | | | |
| •Primary | •15 min | •15 min | •one signal only | |
| •Alternate | •30 min | •30 min | | |
| •Supervisory | •15 min | | | |
| PRIORITY | | | | |
| •Primary | •high | •medium | •low | |
| •Alternate | •high | •medium | | |
| •Supervisory | •low | | | |
| FAILURE CHECK | | | | |
| •Primary | •restart unless canceled | •restart unless canceled | •N/A | |
| •Alternate | •restart unless canceled | •restart search at primary level for 24 hours unless canceled | | |
| •Supervisory | •restart search at primary level for 72 hrs unless canceled | | | |
| DEFAULT TARGETS | | | | |
| •Primary | •Provider & Head Nurse for Ward | •Provider & Ward Head Nurse | •Provider | |
| •Alternate | •Class of Physicians for the ward, Class of RNs for the ward | •Class of Physicians for ward, Class of RNs for the ward | | |
| •Supervisory | •Dept Head, Med Dir, Hosp Dir, Security Dir, Class of Lab Tech | | | |

The search plan also defines search termination conditions. These conditions may include time, number of delivery attempts, confirmation level, cancellation from a supervisory target 34, change in originating event, aborting signal received from authorized user, etc. It also describes the device or form assisted by user device profiles 28 (E-Mail with pre-specified text, touch-tone code on a voice response system, a certain new event on the event file, etc.) that confirmation may take, the time allotted to the search process, post-mortem status signalling requirements, etc.

The processor 20 also composes the necessary messages for signalling per a predetermined format specified in user and target profiles 18. This message can be specific for various parameters such as type of event, type of device that will receive the message, type of target (primary target 30, secondary target 32 or supervisory target 34), target preferences, etc. The message may also be defined to include data from either the event itself, or relevant data from the database of the application (e.g., lab or radiology) that generated the event but which does not appear on the data or entry for the event.

The signalling elements of the search plan, including the timing of each signal, the message to be signaled, the type of device to use, the relative priority of signalling for this alert, choices of other alerts, the address of the device (i.e. phone numbers, extensions, E-Mail addresses, etc.) are passed as signal requests 22 to a transmitter 24. The transmitter 24 utilizes device-specific information on how to signal to each such device contained in the device profiles 28 to effect the required signalling specified in signal requests 22 as long as the alert has not been terminated. Transmitter 24 also provides recorder 36 with information documenting the time, date and result of each attempted signal (e.g., message M successfully transmitted on device D, or message transmission failed due to error R).

Signal requests 22 reflect user preferences for the one or more primary targets 30 to have confirmed message delivery, as well as for the "escalation" to one or more alternate targets 32 deemed acceptable for confirmed message delivery if no primary target confirmation has been received, and the one or more supervisory targets 34 which can be notified of failed searches and which can determine if the search is to continue, be restarted, or be canceled.

Users wishing to respond to an alert will communicate with the responder 26. The responder 26 validates that an authorized recipient or target recipient has received the message and whether such a person is capable of responding to the alert in the manner requested (confirming, cancelling, restarting, or status inquiry). Authorized recipients confirming or cancelling an alert causes the transmitter 24 to stop alert signalling. Transmitter 24 at this point would send any defined post-mortem search status signals to targets defined to receive them (typically, only to targets that have been signaled relevant to this alert but who did not confirm).

All recipients of communications and interactions with responder 26 are documented by recorder 36. This includes the identity of such recipients, the time and date, the specific alert they are referencing, and the user's action relative to that alert.

The alerting system 100 of this invention can also be programmed with the capability of escalating failed searches to supervisory agents that can specify if the search is to continue, be restarted or terminated. Such supervisors can specify the intensity and invasiveness of further search efforts depending upon the event type and the age of the event. Supervisors can accept a response when primary and alternate targets have not responded, so long as they belong to a class deemed competent to respond to the particular event type. One example would be to alert a lab technician to receive lab results if the physician has not responded to the alert within one hour.

The present system can also be set up to define generic signalling directed at a particular class, rather than a specific target, and allow confirmation by any class member. It can be programmed to discriminate among all possible respondents to a search and document the identity of the specific agent responding. The system can also impose variable confirmation requirements per user preferences for any given event type and incorporate event information into the signalling depending upon the user preferences and communication device limitations. For example, the system may use LCD display pagers which can provide alpha-numeric signals or sentences for interpretation by a primary caregiving physician. The alpha-numeric information provided to the physician can vary from event to event, and if the signal is sent to an alternate target or a supervisor, a different message can be delivered by the transmitter 24.

The alert can provide on-demand status to users while the search is in progress, and can signal a post-mortem search result status using various communication devices preprogrammed by the user device profiles 28.

This invention preferably uses certain host communications database systems to access events and various information not physically contained on the searching system (for example, the event-type information profile 14 and the user and target profiles 18) or indicia, such as data for the message, to be signaled that is on application databases elsewhere and not contained in the event itself. The preferred embodiment searches a network database for indicia for triggering events 16.

The network access also enables the alerting system to leverage existing network resources for the search. Common network resources include E-Mail, fax servers, printers, pop-up note delivery for active users, alpha-numeric paging capability, and bridges and routers to send messages to wireless devices. This capability also enables users to send electronic status inquiries or confirmation for searches, and can enable authorized users to log onto the alerting system to inquire about status or change system parameters or to abort the alert as if they were on the alerting system console itself.

This invention can employ voice communications devices to signal audible messages to devices such as various types of telephones, overhead pagers, personal voice pagers, speakers, voice mail, etc. The preferred embodiment uses standard computer telephony devices. Authorized users can therefore call to confirm or cancel searches, to inquire on search status, and obtain additional information relevant to the event that may not have been signaled to a users' specific device.

The invention can also use text communications means to signal textual messages to devices such as printers, facsimile machines, alpha-numeric pagers, TTY's, TDD's, and modem, network or wireless equipped computers or PDA's. This capability enables authorized users on devices capable of similar signalling to confirm or cancel searches, or to inquire on search status, or obtain additional information not signaled to a specific device. The preferred embodiment uses RS232 and modem based devices for this purpose.

The alerting system of this invention can also use electric/electronic communications means to signal devices such as lights, alarms and buzzers, moving devices, etc. Basic confirmation is possible from such devices capable of generating a detectable event or signal such as opening or closing a circuit via a switch, or generating an electrical signal of predetermined characteristics.

From the foregoing, it can be realized that this invention provides alarm systems and methods for alerting target recipients for reporting medical data and patient status. These systems can identify one or more preferred agents to receive an alert signal based upon user preferences for the individuals who should respond to a particular type of event. The system can operate over one or more types of generic communications devices without expensive custom-made equipment or tying the target recipients to monitoring stations. The alerting systems of this invention can determine if and when an intended user has received the alert, and can escalate to find one or more alternative targets which have previously been deemed acceptable by the user if the primary target cannot be confirmed in the time limit specified. Although various embodiments have been illustrated, this was for the purpose of describing, and not limiting the invention. Various modifications, which will become apparent to one skilled in the art, are within the scope of this invention.

What is claimed is:

1. A medical alerting system for communicating a preselected output representative of healthcare-related information to one or more target recipients, comprising:

(a) receiver means for detecting indicia of said healthcare-related information;

(b) processing means for assigning a preselected output to said indicia and for mapping to a particular primary target recipient;

(c) transmission means for signalling said preselected output to said primary target recipient; and (d) recording means for recording evidence that said preselected output has been delivered to an authorized recipient, wherein said evidence comprises an identifier selected from the group including: E-mail with prespecified text, touch-tone code, or a new event recorded on an event profile of said processing means.

2. The alerting system of claim 1, wherein said processing means assigns said preselected output in relation to the content of said healthcare-related information.

3. The alerting system of claim 1, wherein said processing means can be activated to select a secondary target recipient if said primary target recipient does not acknowledge receipt of said preselected output within a preselected time limit.

4. The alerting system of claim 3, wherein said one or more target recipients are selected from an ordered list of target recipients selected from: primary providers, alternate providers, nursing professionals, and supervisors.

5. The alerting system of claim 1, wherein said transmission means signals said preselected output to an electronic communication device selected from: a personal digital assistant, loud speaker, lights, facsimile, beeper, overhead pager, personal voice pager, telephone, voicemail system or E-Mail system.

6. The alerting system of claim 1, wherein said preselected output is selectively signaled to said target recipient depending upon the medical urgency of said message.

7. The alerting system of claim 1, wherein said processing means defines a time limit prior to signalling a secondary recipient.

8. The alerting system of claim 1, wherein said processing means comprises a computerized telephony system.

9. An alerting system for communicating a message representative of a healthcare condition documented on a database to a class of target recipients, comprising:

(a) receiver means for detecting said healthcare condition on said database;

(b) processing means for assigning a preselected output depending upon the content of said healthcare condition, and for mapping a signalling of said output to at least a primary class of target recipients;

(c) said processing means being escalated to select at least one secondary target recipient in the event that an authorized recipient within said class of target recipients does not acknowledge receipt of said preselected output by inputting a coded identifier within a preset time limit; and (d) signal transmission means for signalling said preselected output to said primary or secondary target recipients.

10. The alerting system of claim 9, wherein said receiver means and said signal transmission means comprise portions of a computerized telephony system.

11. The alerting system of claim 9, wherein said processing means comprises selectively adjustable data profiles for varying said preselected output, the identity of said target recipients, and a manner in which said preselected output is signalled.

12. The alerting system of claim 9, further comprising recording means for recording evidence that a preselected output has been delivered to at least one authorized recipient.

13. The alerting system of claim 12, wherein said evidence comprises means for determining an identity of said authorized recipient and for determining when said recording was made.

14. The alerting system of claim 9, wherein said processing means comprises means for reporting a status of any delivery of said output to an authorized recipient.

15. A method of communicating a message representative of a healthcare condition from a medical facility to one or more target recipients, comprising:

(a) detecting indicia of a healthcare condition;

(b) assigning a preselected output in response to the content of said healthcare condition;

(c) transmitting said preselected output to a primary target recipient;

(d) escalating to one or more secondary target recipients in the event said primary target recipient does not acknowledge receipt of said preselected output with a coded identifier within a preselected time limit and (e) providing a postmortem search status communication to at least one target recipient who does not acknowledge receipt.

16. The method of claim 15, further comprising receiving a verification code from a target recipient and recording evidence of the identity of said target recipient.

17. The method of claim 15, further comprising reporting a status of said healthcare condition to a target recipient.

18. The method of claim 15, further comprising transmitting said preselected output to an electronic device selected from the group comprising:

a telephone, beeper, pager, E-Mail device or voicemail device.

19. The method of claim 15, further comprising initiating said assigning step upon the completion of a lab test.

20. A method of communicating a preselected output representative of a healthcare condition from a medical facility comprising:

(a) detecting data related to said healthcare condition from a database;

(b) processing said data to assign a preselected output to said data depending upon the nature of said condition;

(c) mapping said output to a primary target recipient who is not actively monitoring said condition;

(d) transmitting said output to said primary target recipient;

(e) selecting at least one secondary target recipient in the event that said primary target recipient does not acknowledge receipt of said preselected output within a preset time limit and (f) providing a postmortem search status communication to at least one target recipient who does not acknowledge receipt of said preselected output.

* * * * *